US007469796B2

(12) United States Patent
Kamineni et al.

(10) Patent No.: US 7,469,796 B2
(45) Date of Patent: Dec. 30, 2008

(54) CONTAINER EXHIBITING IMPROVED TOP LOAD PERFORMANCE

(75) Inventors: Satya Kamineni, Lockport, IL (US); Michael Mooney, Frankfort, IL (US)

(73) Assignee: Constar International Inc., Philadelphia, PA (US)

( * ) Notice: Subject to any disclaimer, the term of this patent is extended or adjusted under 35 U.S.C. 154(b) by 0 days.

(21) Appl. No.: 10/565,880

(22) PCT Filed: Nov. 5, 2003

(86) PCT No.: PCT/US03/35337

§ 371 (c)(1),
(2), (4) Date: Aug. 18, 2006

(87) PCT Pub. No.: WO2004/080828

PCT Pub. Date: Sep. 23, 2004

(65) Prior Publication Data

US 2007/0012649 A1 Jan. 18, 2007

(51) Int. Cl.
*B65D 1/42* (2006.01)

(52) U.S. Cl. ..... 215/382; 215/383; 220/673; 220/675

(58) Field of Classification Search ..... 215/379–383; 220/669, 672, 673, 675
See application file for complete search history.

(56) References Cited

U.S. PATENT DOCUMENTS 3,335,902 A 8/1967 Javorik
3,357,593 A * 12/1967 Sears, Jr. et al. ..... 220/670
5,054,632 A 10/1991 Alberghini et al.
5,067,622 A 11/1991 Garver et al.
5,101,990 A * 4/1992 Krishnakumar et al. ..... 215/383
5,199,588 A 4/1993 Hayashi
5,201,438 A * 4/1993 Norwood ..... 220/666
5,690,244 A 11/1997 Darr
5,988,417 A * 11/1999 Cheng et al. ..... 215/383
D423,940 S * 5/2000 Chimetto ..... D9/541
6,062,409 A * 5/2000 Eberle ..... 215/381
6,179,142 B1 * 1/2001 Hansen ..... 215/382
6,230,912 B1 5/2001 Rashid
D494,473 S * 8/2004 Yourist ..... D9/516

(Continued)

FOREIGN PATENT DOCUMENTS

GB 2330125 4/1999

(Continued)

OTHER PUBLICATIONS

International Search Report and Written Opinion issued for International Patent Application No. PCT/US2003/35337.

*Primary Examiner*—Sue A Weaver
(74) *Attorney, Agent, or Firm*—Wilmer Cutler Pickering Hale & Dorr LLP

(57) ABSTRACT

A plastic container (10) that exhibits an optimal ratio of hoop strength to top load strength includes a finish portion (12) and generally cylindrical main body portion (14). The main body portion includes a sidewall (16) that has a first plurality of generally vertical ribs (18, 20, 21, 24) defined therein. In addition, a second plurality of generally horizontal wave (26, 28, 30, 32, 34, 36) shaped ribs is defined in the sidewall. The generally horizontal wave shaped ribs intersect with the generally vertical ribs, thereby imparting enhanced strength characteristics to the container (10).

13 Claims, 2 Drawing Sheets

U.S. PATENT DOCUMENTS

| | | | | |
|---|---|---|---|---|
| 6,779,673 | B2 * | 8/2004 | Melrose et al. | 215/381 |
| D506,139 | S * | 6/2005 | Zboch et al. | D9/539 |
| D522,874 | S * | 6/2006 | Livingston et al. | D9/552 |
| D523,347 | S * | 6/2006 | Livingston | D9/552 |
| D527,267 | S * | 8/2006 | Zboch et al. | D9/516 |
| 2003/0010743 | A1 * | 1/2003 | Boukobza | 215/382 |
| 2003/0080135 | A1 * | 5/2003 | Bezek | 220/673 |

FOREIGN PATENT DOCUMENTS

| | | | |
|---|---|---|---|
| JP | 09240647 | | 9/1997 |
| JP | 10203519 | | 4/1998 |
| JP | 11130035 | | 5/1999 |
| WO | WO 96/01212 | * | 1/1996 |

* cited by examiner

CONTAINER EXHIBITING IMPROVED TOP LOAD PERFORMANCE

BACKGROUND OF THE INVENTION

1. Field of the Invention

This invention relates generally to the field of consumer packaging. More specifically, this invention relates to plastic containers of the type that are used to package consumer beverages, and the strength characteristics of such plastic containers.

2. Description of the Related Technology

Plastic containers are in wide use commercially throughout the world for packaging liquids of all types, including consumer beverages. The most common type of plastic container that is used for packaging, for example, soft drinks, is fabricated from polyethylene terephthalate (PET) and is molded into a desired shape using a blowmolding process that is well known in the industry.

In the design of such containers, a number of factors are ordinarily considered. The container must be chemically resistant and should be shaped to avoid concentration of stress that result in unwanted failure. In addition, the container must be strong enough to endure the packaging process and subsequent handling during the gross packaging, shipping and retail display stages.

One type of strength that plastic containers are regularly evaluated for it is that of top load strength. Top load strength involves resistance to failure, typically sidewall buckling, when a vertical force is exerted onto the top of the container. Such vertical force is exerted onto the container during the filling process and when the closure is installed onto the container. In addition, a great deal of vertical force may be exerted onto filled containers when cases of the containers are stacked during shipping. Another type of strength that is regularly evaluated in the design of plastic containers is hoop strength. Hoop strength is the resistance provided by the container against the tendency of the container sidewall to bow outwardly or deflect inwardly when the contents of the container are under pressurization or when external forces are applied to the outside of the container, which of course is a common scenario in the packaging and transportation of carbonated soft drinks.

It is generally known in the industry that circumferential reinforcement such as ribbing tends to increase hoop strength, and that vertical reinforcement has a favorable effect on top load strength. However, it should be understood that there is a to economic disincentive to provide any more reinforcement to a plastic container design than is absolutely necessary, because increased reinforcement tends to make the container heavier and thus more expensive to manufacture. A need exists, then, for a plastic container design that optimizes hoop strength and top load strength while minimizing the amount of plastic material that is necessary to fabricate the container.

SUMMARY OF THE INVENTION

Accordingly, it is an object of the invention to provide a plastic container design that optimizes hoop strength and top load strength while minimizing the amount of plastic material that is necessary to fabricate the container.

In order to achieve the above and other objects of the invention, a plastic container that is constructed according to a first aspect of the invention includes a finish portion; and a generally cylindrical main body portion, said main body portion comprising a sidewall having a first plurality of generally vertical ribs defined therein, the sidewall further having a second plurality of generally horizontal wave shaped ribs defined therein, at least one of the generally horizontal wave shaped ribs intersecting with at least one of the generally vertical ribs, whereby enhanced strength characteristics are imparted to the container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
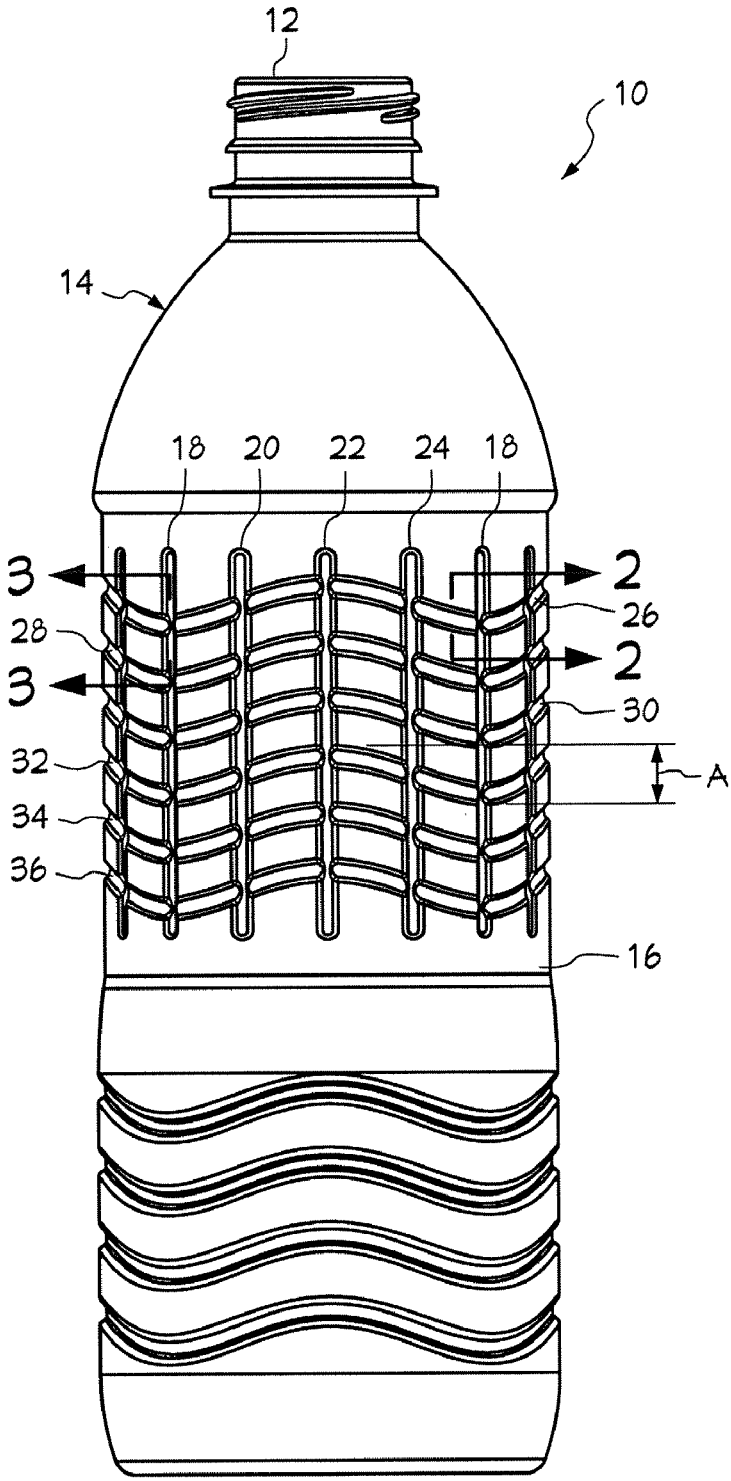
FIG. 1 is a side elevational view of a plastic container that is constructed according to a preferred embodiment of the invention.
Figure 2:
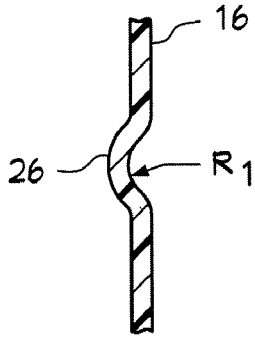
FIG. 2 is a cross-sectional view taken along lines 2-2 in FIG. 1.
Figure 3:
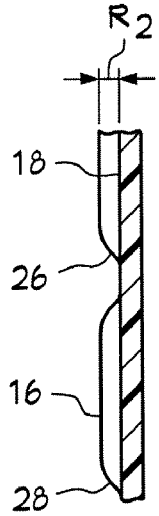
FIG. 3 is a cross-sectional view taken along blinds 3-3 in FIG. 1.

Referring now to the drawings, wherein like reference numerals designate corresponding structure throughout the views, and referring in particular to FIG. 1, a plastic container 10 that is constructed according to a preferred embodiment of the invention includes a finish portion 12 and a generally cylindrical main body portion 14 having an outer sidewall 16. Preferably, plastic container 10 is fabricated from a plastic material such as polyethylene terephthalate. As may be seen in FIG. 1, body portion 14 has a first plurality of generally vertical ribs 18, 20, 22, 24 defined therein. Vertical ribs 18, 20, 22, 24, as shown in the cross-sectional view provided in FIG. 3, are substantially concave, having a radius of depth $R_2$, and extend generally radially inwardly toward the center axis of the container 10. The vertical ribs are preferably parallel to each other and evenly spaced from each other over the outer circumference of the main body portion 14 of the container 10.

As may further be seen in FIG. 1, the sidewall 16 further has a second plurality of generally horizontal wave shaped ribs 26, 28, 30, 32, 34, 36 defined therein. The generally horizontal wave shaped ribs 26, 28, 30, 32, 34, 36 preferably extend so as to be parallel with each other and are substantially evenly spaced from each other. It follows, then, that each of the wave shaped ribs has a common amplitude A and wavelength with each of the other wave shaped ribs, with the amplitude A being defined as the peak to peak vertical distance between the uppermost point of the wave crest to the lowermost point of the adjacent wave trough and the wavelength being defined as the circumferential peak to peak distance traveled by the rib from wave crest to wave crest. Each horizontal wave shaped rib is substantially concave, having a radius of depth $R_1$, and extending inwardly toward the center axis of the container 10. As may be seen in FIG. 1, at least one of the generally horizontal wave shaped ribs intersects with at least one of said generally vertical ribs, whereby enhanced strength characteristics are imparted to the container.

In the preferred embodiment, it will be seen that each of the generally horizontal wave shaped ribs 26, 28, 30, 32, 34, 36 intersects with each of the 16 vertical ribs. Preferably, a plurality, and more preferably at least three of the vertical ribs intersect each wave shaped rib within each wavelength. According to one important aspect of the invention, the location or placement of the vertical ribs is harmonized with respect to the waveform of at least one of the horizontal ribs. In the preferred embodiment, the vertical ribs 18, 20,22, 24 will intersect each of the generally horizontal wave shaped ribs 26, 28, 30, 32, 34, 36 in a repeating pattern such that each of the vertical ribs 18 intersects each wave shaped rib at the lowermost point of the wave trough, and so that each of the vertical ribs 20 intersects each wave shaped rib at a median location between the wave trough and an adjacent wave peak. Also, each vertical rib 22 will intersect each wave shaped rib at the wave peak and each vertical rib 24 will intersect each wave shaped rib at a median location between the wave peak and the next wave trough. Accordingly, at least one of the generally vertical ribs 18, 20, 22, 24 intersects at least one of the generally horizontal wave shaped ribs 26, 28, 30, 32, 34, 36 at a location of maximum amplitude of the wave shaped rib, and another one of the generally vertical ribs intersects the horizontal wave shaped rib at a location of minimum amplitude. This is believed to maximize both the hoop strength and top load strength that is achievable by the structure.

Figure 4:
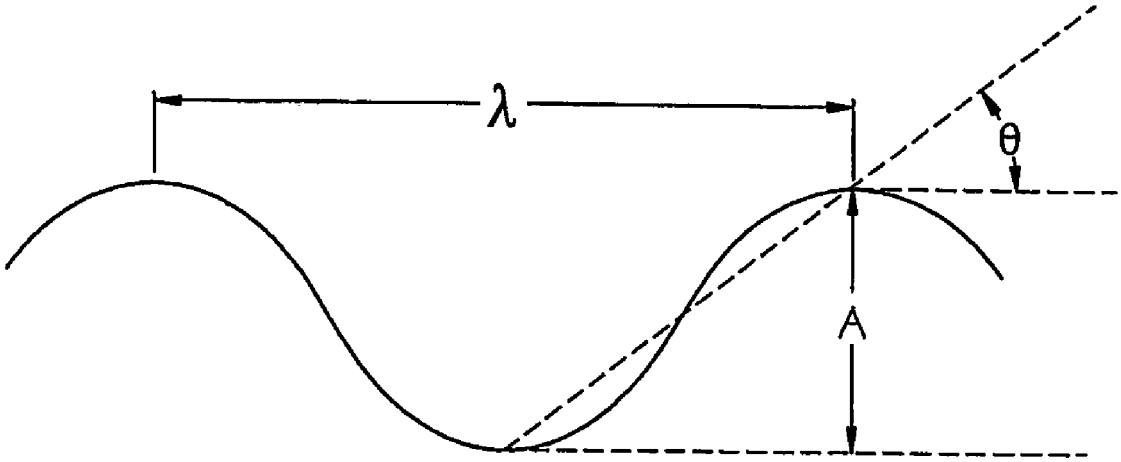
FIG. 4 is a diagrammatical depiction of one of the wave-shaped ribs with the circumference of the container represented along the x-axis.

As may be visualized in FIG. 1, sidewall 16 of the generally cylindrical main body portion 14 has an outer circumference. As is shown in FIG. 4, which is a diagrammatical depiction of one of the wave-shaped ribs with the circumference of the container represented along the x-axis, each wave-shaped rib preferably has a repeating wavelength $\lambda$ and a common amplitude A. An angle $\theta$ is defined by a triangle, two legs of which are equal to the amplitude A and one-half the wavelength $\lambda$. Preferably, the amplitude A of the wave shaped ribs is within a range of about 4.5 percent to about 30 percent of the wavelength $\lambda$, which corresponds to angle $\theta$ being within a range of about 5 degrees to about 30 degrees. The wavelength $\lambda$ should preferably be about 6 percent to about 40 percent of the outer circumference of the container.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a finish portion; and a generally cylindrical main body portion, said main body portion comprising a sidewall having a plurality of generally vertical ribs defined therein, said sidewall further having a plurality of generally horizontal wave shaped ribs defined therein, at least one of said generally horizontal wave shaped ribs having an amplitude that is within a range of about 4.5 percent to about 30 percent of its wavelength, and at least one of said generally vertical ribs intersecting with more than one of said generally horizontal wave shaped ribs, whereby enhanced strength characteristics are imparted to the container.

2. A plastic container according to claim 1, wherein said container is fabricated from a plastic material comprising polyethylene terephthalate.

3. A plastic container according to claim 1, wherein said plurality of generally vertical ribs comprises at least one rib that is inwardly oriented.

4. A plastic container according to claim 1, wherein said plurality of generally horizontal wave shaped ribs comprises at least one rib that is inwardly oriented.

5. A plastic container according to claim 1, wherein said plurality of generally horizontal wave shaped ribs comprises a plurality of wave shaped ribs that extend generally parallel to each other.

6. A plastic container according to claim 1, wherein said generally horizontal wave shaped ribs are shaped so as to have a common amplitude and a common wavelength.

7. A plastic container according to claim 6, wherein said sidewall has an outer circumference, and said wavelength of said generally horizontal wave shaped ribs is within a range of about 6 percent to about 40 percent of said outer circumference.

8. A plastic container according to claim 1, wherein said at least one generally vertical rib intersects said generally horizontal wave shaped ribs at a location of maximum amplitude of each intersected horizontal wave shaped rib.

9. A plastic container according to claim 1, wherein said at least one generally vertical rib intersects said generally horizontal wave shaped ribs at a location of minimum amplitude of each intersected horizontal wave shaped rib.

10. A plastic container according to claim 1, wherein more than one of said generally vertical ribs intersect more than one of said generally horizontal wave shaped ribs, and each intersected horizontal wave shaped rib is intersected within each wavelength.

11. A plastic container according to claim 10, wherein the locations of said generally vertical ribs are harmonized with respect to a waveform of at least one of said generally horizontal wave shaped ribs.

12. A plastic container according to claim 1, wherein said generally horizontal wave shaped ribs are defined on a generally convex outer surface of said generally cylindrical main body portion.

13. A plastic container according to claim 1, wherein said generally horizontal wave shaped ribs extend all the way about an outer circumference of said generally cylindrical main body portion.

* * * * *